US006769219B2

(12) United States Patent
Schwitte et al.

(10) Patent No.: US 6,769,219 B2
(45) Date of Patent: Aug. 3, 2004

(54) PANEL ELEMENTS

(75) Inventors: Richard Schwitte, Gescher (DE); Ansgar Mensing, Heek-Nienborg (DE)

(73) Assignee: Hulsta-Werke Huls GmbH & Co., Stadtohn (DE)

( * ) Notice: Subject to any disclaimer, the term of this patent is extended or adjusted under 35 U.S.C. 154(b) by 0 days.

(21) Appl. No.: 10/195,711

(22) Filed: Jul. 15, 2002

(65) Prior Publication Data

US 2002/0170258 A1 Nov. 21, 2002

Related U.S. Application Data

(63) Continuation of application No. PCT/EP01/00360, filed on Jan. 12, 2001.

(30) Foreign Application Priority Data

Jan. 13, 2000 (DE) ..... 100 01 076

(51) Int. Cl.[7] ..... E04B 2/08
(52) U.S. Cl. ..... 52/592.1; 52/590.3; 52/592.4
(58) Field of Search ..... 52/590.2, 590.3, 52/592.1, 592.4

(56) References Cited

U.S. PATENT DOCUMENTS

| | | | |
|---|---|---|---|
| 4,426,820 | A | 1/1984 | Terbrack et al. |
| 5,348,778 | A | 9/1994 | Knipp et al. |
| 6,209,278 | B1 | 4/2001 | Tychsen |
| 6,216,409 | B1 | 4/2001 | Roy |
| 6,247,285 | B1 | 6/2001 | Moebus |
| 6,345,481 | B1 | 2/2002 | Nelson |

FOREIGN PATENT DOCUMENTS

| | | | |
|---|---|---|---|
| CA | 991373 | | 6/1976 |
| CH | 562377 | | 11/1972 |
| DE | 2940945 | A1 | 4/1981 |
| DE | 3343601 | C2 | 2/1987 |
| DE | 4122099 | C1 | 10/1992 |
| DE | 19503948 | A1 | 8/1996 |
| DE | 29710175 | U1 | 8/1997 |
| DE | 29803708 | U1 | 5/1998 |
| DE | 19718319 | A1 | 11/1998 |
| DE | 19851200 | C1 | 11/1998 |
| DE | 20001788 | U | 2/2000 |
| DE | 29922649 | U1 | 4/2000 |
| DE | 20008708 | U | 5/2000 |
| EP | 0085196 | A1 | 10/1983 |
| EP | 0562402 | A1 | 3/1993 |
| EP | 0877130 | B | 4/1994 |
| EP | 0715037 | A1 | 6/1996 |
| EP | 0855482 | B | 12/1999 |
| EP | 1045083 | A1 | 10/2000 |
| FR | 2278876 | | 10/1973 |
| FR | 2785633 | A1 | 5/2000 |
| GB | 1161838 | | 8/1969 |
| GB | 2256023 | A | 11/1992 |
| JP | 7-300979 | | 11/1995 |
| WO | WO 9627719 | A | 9/1996 |
| WO | WO 98/58142 | | 6/1997 |
| WO | WO 97/47834 | | 12/1997 |
| WO | WO 0047841 | A | 8/2000 |
| WO | WO 00/63510 | A1 | 10/2000 |
| WO | WO 01/02670 | A1 | 1/2001 |
| WO | WO 0/148332 | A1 | 7/2001 |
| WO | WO 01/88306 | A1 | 11/2001 |

*Primary Examiner*—Carl D. Friedman
*Assistant Examiner*—Basil Katcheves
(74) *Attorney, Agent, or Firm*—Wolf, Greenfield & Sacks, P.C.

(57) ABSTRACT

Panel elements are provided comprising several interconnecting panel elements of the same type. The panel elements comprise a groove formed by an upper groove cheek and a lower groove cheek and a tongue. The tongue comprises a rib oriented in a longitudinal direction of the tongue, and the groove comprises a retaining channel for receiving the rib of an adjoining panel element. The tongue cooperates with the groove of an adjoining same-type panel element such that the two panel elements, when married, are safeguarded against parting forces acting in both axis oriented perpendicular to the side of the two panel elements.

10 Claims, 5 Drawing Sheets

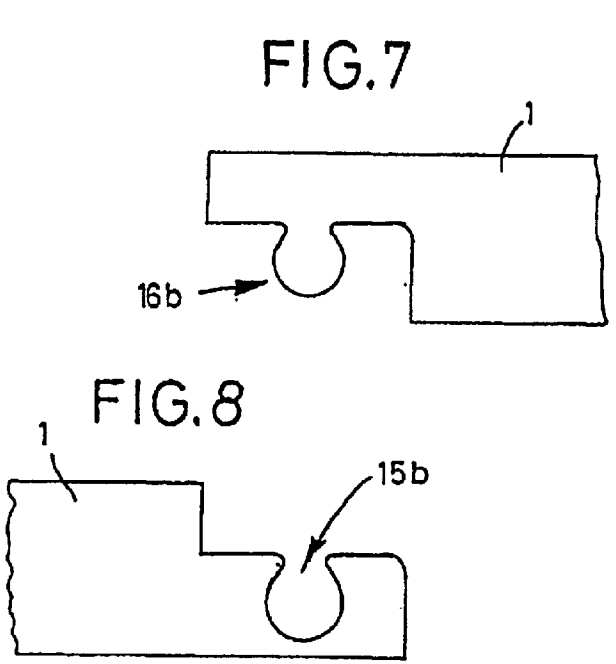
FIG.7
FIG.8
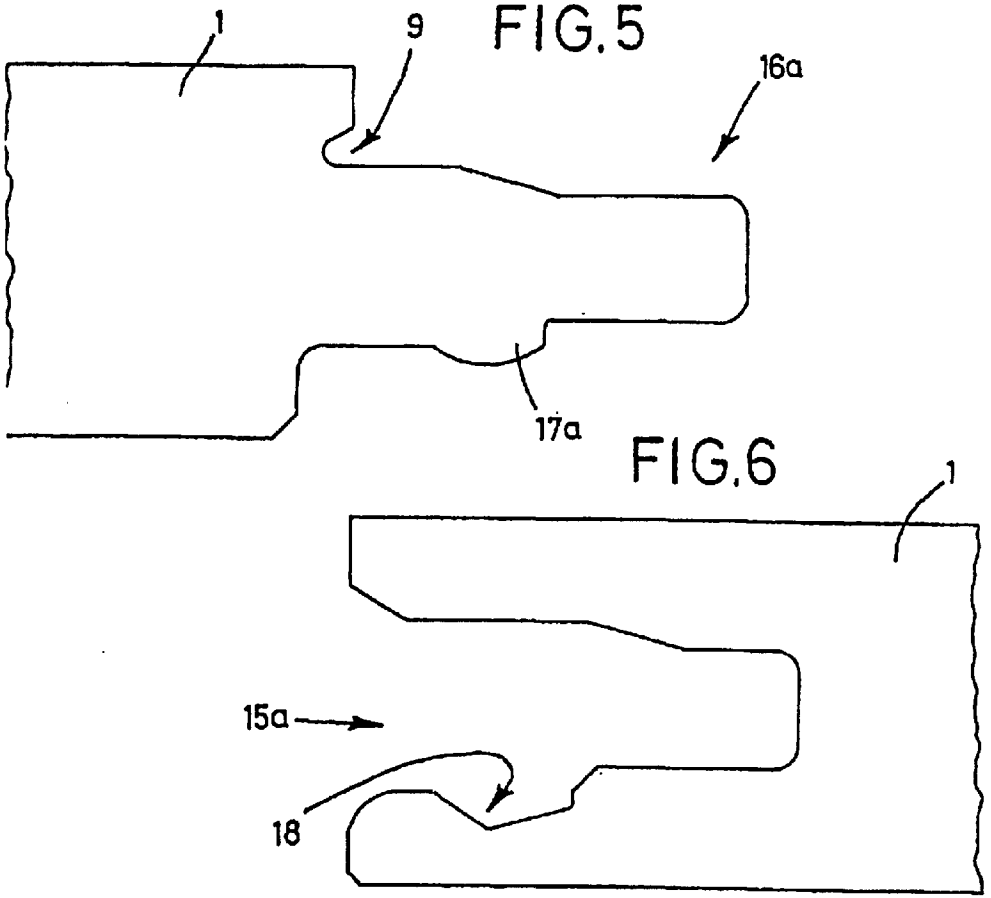
FIG.5
FIG.6

PANEL ELEMENTS

RELATED APPLICATIONS

This application is a continuation under 35 U.S.C. §120 of International Patent Application Serial No. PCT/EP01/00360, filed Jan. 12, 2001, which claims foreign priority benefits under 35 U.S.C. §119(a)–(d) or 35 U.S.C. §365(b) of German application number DE10001076.8, filed Jan. 13, 2000.

1. Field of the Invention

The present invention relates to, in general, panel elements, and, in particular, panel elements for forming floor coverings.

2. Related Art

Known from G9 2,256,023 A is a generic panel element. It is provided for in the floor covering formed of several such panel elements that the individual panel elements feature a certain mobility relative to each other. This enables, especially when the panel elements are made of wood and the wood "works" due to exposure to the weather or due to the influence of moisture, any opening up of joints between adjoining panel elements to be avoided since the clearance possible between adjoining panel elements is designed to accommodate such movements of the natural material wood.

In some applications and depending on the furnishing style it may, however, be desirable to restrict the mobility of adjoining floor panel elements in preventing dirt from gaining access to the gaps that may materialize between adjoining panel elements. This is why it is known to fabricate non-generic floor coverings in which the tongue and groove geometries provided therein do not already prevent parting of adjoining floor panel elements. These elements first can be simply jointed, namely married and not fixedly connected until glued and safeguarded against the cited parting forces so that neither moisture nor dirt is able to gain access at the joints of two adjoining panel elements.

It is known in the field of the generic panel elements from WO 96/27719 to configure a groove from two adjoining edges of an elongated panel element, i.e. a side and an end, and to provide the lower cheek of the groove as a protruding element including a channel for receiving a complementary interlocking element at the opposite side in each case. The complementary interlocking element is configured to a certain extent at the underside of a tongue for inserting into the groove. As cited in this document these interlocking contours are configured the same on all four edges, and laying is done in rows. This means that the juxtaposed panel elements of one row to be laid first need to be connected to each other at their ends before then being married by their sides to the sides of the panels already laid. Such a procedure is, however, relatively laborious and a nuisance since several panel elements interlocked by their ends need to be handled.

Known from DE 297 10 175 U1 is a floor covering consisting of hard floor panels. The panels are provided at their sides and ends with interlocking contours. In this arrangement a panel to be newly laid is insertable into already laid panels by a swivel movement or by a horizontal shifting movement. Common to the various solutions shown is that they comprise, in the region of retaining rib and retaining groove, a bevelled contact surface area that enables a panel to turn about the butt joint at the face surface with relatively little effort and become released from the adjoining panel, resulting in gaps materializing.

Known from EP 0 855 482 B1 and EP 0 877 130 B1 is a method of laying floor panels or a floor in which one of the panels comprises an interlocking strip protruding at the underside relative to the edge by a protruding interlocking element. The interlocking profile complementary thereto comprises an interlocking groove into which the interlocking element can latch. In this arrangement no positional definition materializes since to ensure subsequent shiftability in the direction of the sides a clearance needs to be provided between the interlocking element and the interlocking groove.

Known from the DE 298 03 708 U1 is a panel for joining to an adjoining panel comprising a complementary interlocking profile but which cannot be interlocked.

Known from WO 98/58142 are panel-like components comprising on their sides a groove on one side, and a tongue on the other. The groove is configured substantially tapered so that a correspondingly configured tongue can be inserted therein. Configured at the underside of the tongue is a protuberance, and at the lower definition of the groove there is provided a recess. The protuberance is able to latch into place in the recess such that adjoining panels are safeguarded from being parted.

In conclusion, a system is known from DE 195 03 948 A1 comprising floor panels and separate retaining elements featuring rounded interlocking contours. Due to the necessity of separate retaining elements this system is complicated to lay.

SUMMARY OF THE INVENTION

One aspect of the invention is to directed to providing a panel element for forming a floor covering permitting a simple glueless laying of the floor covering while achieving and reliably maintaining a snug contact in joining adjacent panel elements.

One embodiment of the invention provides panel elements for configuring a floor covering comprising several interconnectable panel elements of the same type. The panel elements comprise a groove formed by an upper cheek and a lower cheek, and a tongue. The tongue cooperates with the groove of an adjoining same-type panel element such that two panel elements, when married, are safeguarded against parting forces acting in both axes oriented perpendicular to the side of the two panel elements. The tongue comprises, at an underside, a rib oriented in a longitudinal direction of the tongue; the groove comprises, at an underside, a retaining channel for receiving the rib of an adjoining panel element. The upper groove cheek of the groove is ramped upwards to a mouth of the groove so as to create an insertion channel for the tongue of a second panel element located at an angle to a laying plane.

In an aspect of the invention, the groove and tongue of the two panel elements, when married, comprise four defined contact locations. A first contact location is configured at an upper side of the tongue and at the upper groove cheek of the groove. A second contact location is configured at the underside of the tongue and at the lower groove cheek of the groove. A third contact location is configured at an upper sidewall of the retaining channel. A fourth contact location is configured at a rounded transition between the retaining channel and the side edge of the panel element at an angle to the third contact location.

BRIEF DESCRIPTION OF THE DRAWINGS

Example embodiments of the invention will now be detailed with reference to the drawings in which

FIGS. 5 and 6 show a first example aspect of an end tongue and groove configuration of a panel element in accordance with one embodiment of the invention, and FIGS. 7 and 8 show a second example aspect of an end tongue and groove configuration of a panel element in accordance with one embodiment of the invention.

DETAILED DESCRIPTION OF PREFERRED EMBODIMENTS

Figure 1:
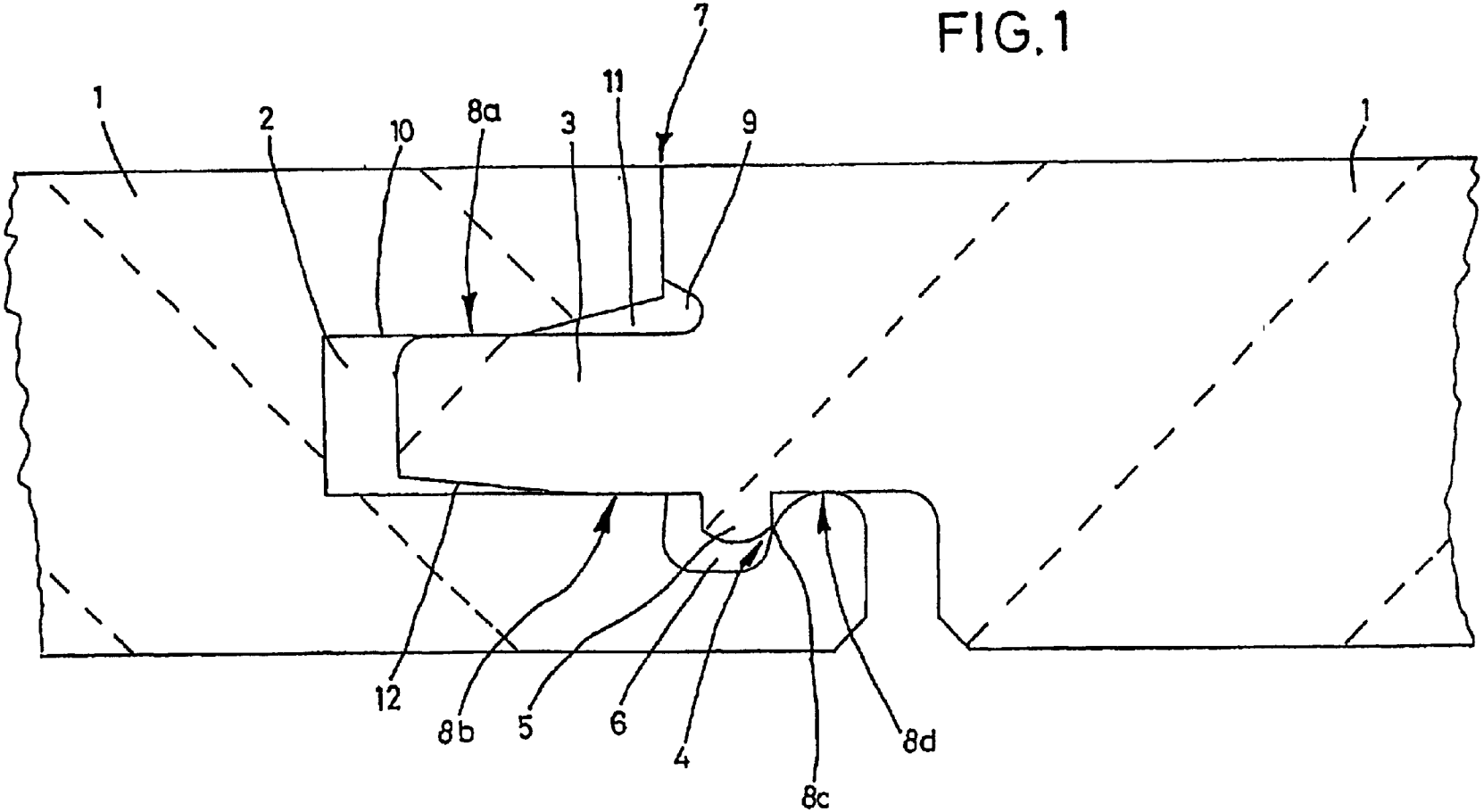
FIG. 1 shows a cross-section through the portion of the tongue and groove configuration of the sides of two married panel elements in accordance with one embodiment of the invention.

Panel elements for forming floor coverings are usually rectangular and elongated, although they may also feature other contours such as square, for example. Accordingly, in keeping with the usual rectangular configuration terms such as "side", "end" or the like are employed in the following. However, the floor coverings of the invention should not be restricted to elongated panel elements, and may comprise other shapes. The terms "sides" and "ends" are used simply to distinguish first and second edges of the panel element. In accordance with an embodiment of the invention, two first edges, termed sides, of the panel element comprise, on the one hand a groove and on the other a tongue, (i.e. the one side of an elongated panel element is provided with a groove and the opposite side a tongue). It is understood that the panel element in accordance with the invention may just as well be configured square so that two first edges, which must not necessarily be longer than the two edges as detailed in the following, are provided with a tongue and groove. At these first edges grooves and tongues formed complementary thereto are configured such that a second panel is located for laying at an angle to a first panel already laid before being swiveled about the side downwards in a plane with the already laid panel element such that the tongue of the panel element to be laid is introduced into the groove of the already laid panel element.

In the final laid condition the tongue of the second panel element cooperates with the groove of the first panel element of the same type adjoining the second panel element in the final condition such that the two married panel elements are safeguarded against parting forces acting in the two axes oriented perpendicular to the longitudinal side of the panel elements. In other words the cooperation of the tongue and groove prevents any of the two panel elements from being lifted out of place relative to the other in a direction perpendicular to the laying plane, i.e. perpendicular to the face surface of the panel elements. For another thing, tongue and groove comprise interlocking contours as detailed in the following for preventing parting of the two panel elements from each other in a direction perpendicular to the sides and parallel to the face surface.

It is preferably provided for that the groove opens upwards at its mouth in thus facilitating insertion of the tongue of a panel element located at an angle. This enables the rib provided on the underside of the tongue to protrude comparatively far downwards from the tongue in enabling high retaining forces to materialize after the floor covering has been laid in reliably preventing parting of the two adjoining panel elements in the laying plane of the floor, in other words in preventing them from being pulled apart transversely to the longitudinal direction of the panel element. Furthermore, beveling the upper cheek of the groove, instead of the underside of the tongue, offers the advantage that the tongue comes into contact with the groove at both the top and bottom in a portion located relatively deeply in the groove in thus assuring a particularly rugged joint since the dimension between the two points of contact and joint spaced the most away from each other in the joint is comparatively large.

In accordance with the invention it is provided for that the geometry of the tongue and groove result in a total of four contact locations between the two panel elements so that in this way the result is relatively rugged in counteracting any parting forces acting transversely to the laying plane of the floor and which could otherwise cause, for example, the adjoining panel element to lift or tilt. In this arrangement the two first contact locations are configured at the tongue and groove themselves, the groove being defined by two cheeks thereof. A first contact location is located at the upper side of the tongue and at the upper cheek of the groove. A second contact location is located at the underside of the tongue and at the lower cheek of the groove. Both the upper side and underside of the tongue, as well as the lower and upper cheek of the groove may be configured, for example, slanted or curved, and the contact locations may be provided, for example, at slanting or curved surface areas.

The third contact location is configured in the outer sidewall of the retaining channel preferably provided in the lower cheek of the groove. The retaining channel is a recess of any suitable geometry oriented parallel to the side edge. Preferably, especially the surface area of the retaining channel located nearer to the edge of the panel is configured at least slightly rounded, although it may just as well be configured, for example, straight or as an angled flat surface area. It is at this side surface area of the retaining channel that the third contact location is preferably oriented substantially vertical. Due to it being oriented in this way the third contact location results in positioning of two married panels in substantially the horizontal direction, in other words preventing the panels from being parted in a direction parallel to the face surface.

The fourth contact location separate from the third contact location is configured at the bottom surface area of the retaining channel or in the surroundings of the retaining channel. This is understood to be portions of the groove cheek provided alongside the recessed retaining channel. It is at one of these portions that the fourth contact location is provided oriented at an angle to the third contact location. For configuring the fourth contact location preference is given to the portion between the retaining channel and the side edge of the panel. In this arrangement this portion may be, for example, rounded so that the sidewall of the retaining channel translates by a rounding into the zone located between the retaining channel and the side edge of the panel. Preferably, the fourth contact location is oriented substantially parallel to the face surface of the panels, as a result of which two interlocked panels can be positioned at the fourth contact location in the vertical direction relative to each other so that their positioning and interlocking connection can still be reliably maintained when the sub-floor is uneven, preventing any difference in height at the juncture. The portion in the surroundings of the retaining channel at which the fourth contact location is provided may also be, for example, rounded. In this case, however, the tangent at the contact location defines the direction which in accordance with the invention is oriented at an angle to the corresponding direction existing at the third contact location.

In configuring the retaining channel and rib, a prominent profiling may be provided to achieve high retaining forces of the married panel elements. In a departure from the laying method as is often employed, in which a panel element is shift-located horizontally to the already laid panel element, it is now provided for in accordance with the invention that the panel elements when laying the floor covering are no longer shifted into each other horizontally, but guided into each other by means of a swivel movement. This now permits selecting a prominent profiling of retaining channel and rib which would not permit two panel elements to be shifted into each other horizontally. However, by making use of a less prominent profiling and flexible configuration of the edge portion it is still possible to make use of the usual purely horizontally shifting method in laying.

An unwanted release could be prompted by the swivel movement as mentioned. The four contact locations counteract such an unwanted swivel movement of two joined panel elements and can produce a regular latching connection requiring a latching force to be first overcome to release the two joined panel elements.

It is preferred that the plane of the groove or tongue is displaced downwards so that above the groove or tongue a material thickness is provided at least equal to or even thicker than that below the groove or tongue. This enables the human or furniture forces exerted in day-by-day use of the floor covering to be better accommodated in reducing the load on the tongue and groove joint so that two adjoining panel elements are subjected to diminished parting forces.

Preferably provided above the tongue is an upper contact surface area extending up to the upper side of the panel element. Advantageously, a glue receiving channel is provided should the panel elements need to be laid permanently by being glued to each other. This glue receiving channel may be provided, for example, in the form of a recess extending longitudinally to and above the tongue, below the upper edge of the panel element, since it is in the region of this upper edge that a contact surface area for contacting an adjoining panel element is provided.

It may further be of advantage to provide two contact surface areas between two adjoining panel elements which prevent any movement in both directions transversely to the longitudinal direction of the panel element (i.e., on the one hand the contact surface area between the two panel elements so that the two panel elements cannot be shifted closer to each other, on the other, a second contact surface area as the contact surface area between the retaining channel, on the one hand, and the rib, on the other, so that the adjoining panel elements are safeguarded against forces tending to pull them apart). In this way, it is now possible to install the panel elements not only with zero clearance but also free of any gap, thus achieving a hygienically satisfactory floor covering featuring a substantially closed face surface.

Tongue and groove interlocking of the sides is additionally facilitated when the underside of the tongue runs rising to the free end of the tongue, thus enabling a panel element to be laid to be located at an angle to an already laid panel element particularly simply by its tongue, before then being swiveled into place.

During the swivel movement on laying a panel element a latching point needs to be overcome; this latching point, after laying, reliably maintains the location of the laid panel elements. To achieve a smooth latching characteristic and thus simplifying laying, it is good practice to configure this latching point between the rib, on the one handside, and the retaining channel, on the other. In this arrangement, the retaining channel in the region of this latching point is rounded with as large a radius as possible so that a gradual increase in the latching pressure to be overcome materializes.

Marrying the individual panel elements of the floor covering particularly intensively is of advantage in avoiding differences in height and thus trip edges in the floor covering whilst providing additional retaining forces also in the longitudinal direction of the panel elements. For this purpose it may be provided for that the panel elements form tongue and groove profiles not only at their sides, but also comprise retaining means at their ends, for example, in the form of tongue and groove profiles. Should it be provided for that the panel elements are to be adjoined by their sides at an angle to each other before then being inserted into each other by a swivel movement, the associated end tongue and groove geometry may be configured, for example, so that it permits joining two panel elements exclusively by a horizontal shifting movement in the laying plane.

As an alternative it may be provided that the retaining means are configured at the ends so that they permit interlocking of two panel elements substantially by a lowering movement made transversely to the laying plane. In accordance with the invention these retaining means, just like the retaining means at the sides, prevent the married panel elements from being lifted out of place relative to each other or parted from each other in a direction perpendicular to the ends and parallel to the laying plane. Any suitable means may be provided as such retaining means. More particularly, these must not necessarily be configured as an interlocking tongue and groove, but may be quite generally a groove or a cheek having a suitable undercut for engaging a protruding element, i.e. a tongue including protuberances, corresponding to the undercut of the groove configured complementary thereto, or a latching protuberance or latching hook.

Advantageously, it is provided that the side groove of the panel element permits adjoining at the right-hand end of the end groove. In this context the terms, "right-hand" and "left-hand" have been selected in a view from above and outside, i.e. not from the centerpoint of the panel element in viewing a panel element oriented ready for laying with its decorative face facing upwards. This groove arrangement is unusual in the normal procedure for laying panel elements and surprising since usually the side groove of a panel element adjoins the left-hand end of the end groove.

The usual systematic approach in laying floor coverings as implemented by professionals and as known from the instructions for laying commercially available floor panel element systems prescribes starting from a specific corner of the room. To reliably achieve a good joint of two adjoining panel elements a specific pressure force usually needs to be exerted, this usually involves use of a block located on the groove edge of the panel element to be newly laid and intended to receive and distribute the hammer blow so that the panel element to be newly laid is urged by the its tongue into the groove of an already laid panel element.

It may happen, especially when the floor is laid by non-professionals, that the block fails to be applied square on the groove edge with the risk of the edge being subjected to excessive force when struck, resulting in the edge of the panel element being deformed and the face surface damaged. This may result in an unwanted gap or a trip joint and may endanger the wet seal of the floor.

The geometry as proposed in the present contributes towards an unusual systematic approach in laying the floor in which, whilst keeping to the direction of laying as usual, the block is now not located on the edge of a groove but on the edge of the tongue of the panel element. The forces preferably applied by the hammer blow to marry the two panel elements are not sufficient to cause deformation of the tongue that could obstruct proper jointing of the two panel elements. Now, in any case, by applying the block to the tongue the face surface of the panel element does not suffer, thus reliably assuring the desired face surface quality of the floor covering.

The insertion channel may be provided at the underside of the tongue to arrange for this underside to ramp upwards to the free end of the tongue, i.e. to bevel or round the underside of the tongue to thus greatly facilitate inserting the tongue into the groove even when the panel is located at an angle.

In the swivel movement on laying a panel element, a latching point needs to be overcome. This latching point ensures, on completion of laying, that the position of the laid panel element is reliably maintained. To achieve as smooth a latching characteristic as possible, thus simplifying laying, it is good practice to configure this latching point between the rib, on the one hand, and the retaining channel, on the other. In this arrangement the retaining channel is rounded in the region of this latching point with as large a radius as possible so that a gradual increase in the latching pressure to be overcome materializes.

FIG. 1 shows two panel elements 1 of the same type, the one panel element 1 comprising a groove 2 and the other panel element 1 a tongue 3 extending into the groove 2 of the adjoining panel element 1. The material thickness of the panel element 1 is slightly more below the groove 2 or above the tongue 3 than below the groove 2 or the tongue 3 respectively so that pressures exerted by human or furniture loads can be accommodated relatively well in loading the tongue and groove joint to a minimum.

The two panel elements 1 are safeguard against being lifted out of place by the meshing effect of the groove 2, on the one hand, and of the tongue 3 on the other. The panel elements 1 are likewise safeguarded against compression forces acting downwards in addition to the support of the panel element 1 by the sub-floor on which the two panel elements 1 are laid.

The panel elements 1 are safeguarded against parting forces acting transversely to the longitudinal direction of the panel elements 1 by a contact surface area 4. Located along this contact surface area 4 a rib 5 configured at the underside of the tongue 3 contacts the sidewall of a retaining channel 6.

The forces tending to urge the two panel elements 1 together are accommodated by a contact surface area 7 at which the two panel elements 1 are in contact with each other and which extends downwards from the upper edge of the two panel elements 1.

As evident from FIG. 1, in the laid condition as evident from FIG. 1 four contact locations 8*a* to 8*d* materialize. In this arrangement, contact location 8*c* is identical to contact surface area 4.

Due to these four contact locations 8*a* to 8*d* the two panel elements 1 are located as regards parting or angling forces so that the two panel elements 1 can only be shifted in parallel relative to each other in their longitudinal direction without any additional retaining force needing to be overcome.

In FIG. 1 a glueless joint of the two panel elements 1 is shown. A recess 9 above the tongue 3 and below the upper contact surface area 7 may serve, however, as a channel to receive excess glue should the two panel elements 1 need to be married permanently and gap-sealed with the aid of glue.

Figure 2:
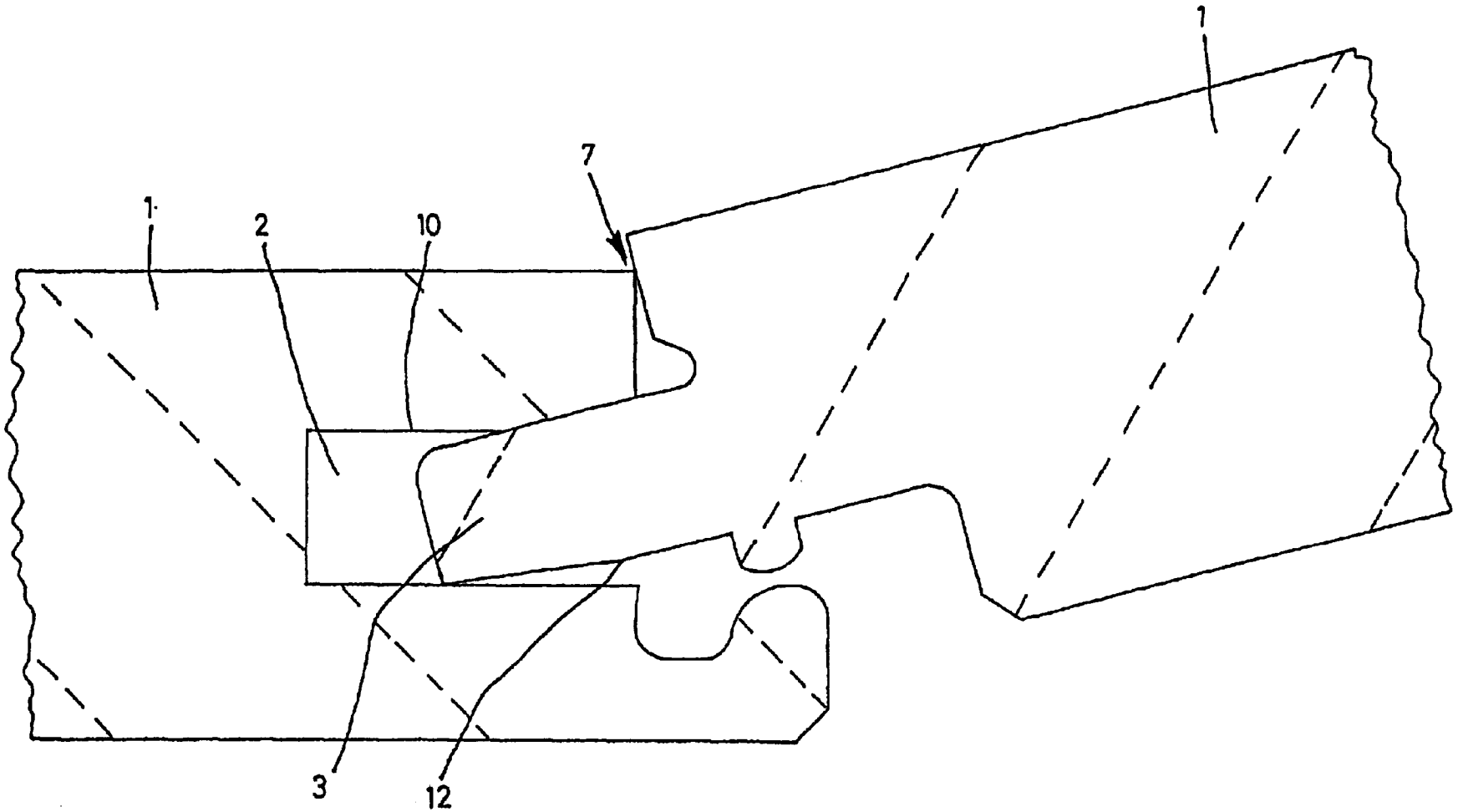
FIGS. 2 and 3 show cross-sections showing the joint of the sides of the two panel elements as shown in FIG. 1 in various stages in laying in accordance with one embodiment of the invention.

FIG. 2, shows how the two panel elements 1 are laid, the left-hand panel element 1, of which the groove 2 is evident, being already laid. The second panel 1 is positioned by its tongue 3 at an angle to the side edge of the first panel 1 whereby the tongue 3 is inserted as far as possible into the groove 2. This is facilitated by the groove 2 comprising an upper edge 10 ramped in the direction of the mouth of the groove 2 in thus forming an insertion channel 11 as shown in FIG. 1.

Likewise the tongue 3 comprises an underside 12 ramped in the direction of the free end of the tongue 3 so that the right-hand panel element 1 can be inserted into the groove 2 as far as possible in its angled position as shown in FIG. 2. This insertion movement is defined, on the one hand, by the tongue 1 contacting the upper and lower defining edges of the groove 2 and, on the other, by the two panel elements 1 in contact with each other in the region of their upper contact surface area 7.

Figure 3:
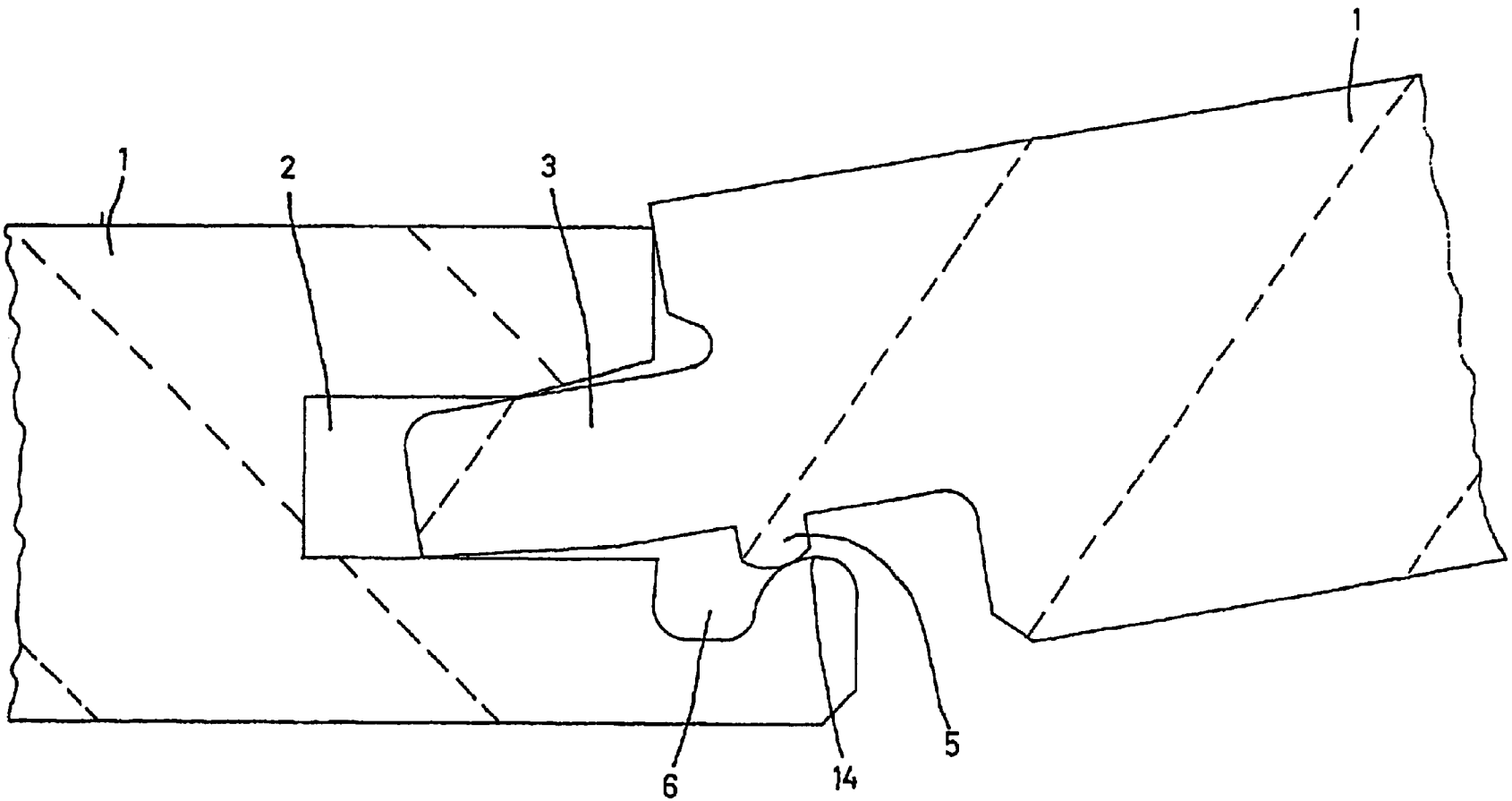

FIG. 3 shows how the right-hand panel element 1 is angled less steeply than as shown in FIG. 2 so that it can be inserted further into the groove 3. In this arrangement the rib 5 comes up against a section 14 by its rounded lower edge, the section running between the retaining channel 6 and the side edge of the panel element 1. The transition from this section 14 to the retaining channel 6 features a relatively large radius: in the example aspect shown the radius of this rounding corresponds to roughly half the width of the retaining channel 6 or half the width of the material below the section 14 by its rounded lower edge, the section running between the retaining channel 6 and the side edge of the panel element 1.

It is due to this "smooth" rounding between the section 14 and the retaining channel 6 that a latching pressure is built up slowly on further insertion of the tongue 3 into the groove 2 which needs to be overcome when laying the right-hand panel element 1 until the two panel elements are then arranged married as shown in FIG. 1. In this laid condition the two panel elements 1 are mated snug, but also free of stress, the rib 5 being received by the retaining channel 6 free of stress. The latching pressure, which again needs to be overcome for the laid panel element 1 to be lifted out of place, locks the marriage of the two panel elements 1. It is to be noted that the interlocking contours are configured such that an oversize is formed. The dimension between the contact surface area 7 and the edge (on the right in FIG. 1) of the rib 5 (i.e., the contact location 8*c*) of the panel comprising the tongue 3, is larger than the corresponding dimension at the panel comprising the groove (i.e., the dimension between the contact location 7 and that of the retaining channel 6 at the third contact location 8*c*). It is furthermore to be noted that the retaining channel is lightly rounded and also the underside of the rib 5 is rounded. The third contact location 8*c* is, however, provided such that the tangent thereto is oriented at least substantially vertically so that, as a result, the panel elements are positioned in the horizontal direction relative to each other. The contact location 8*d* too, is configured in the vicinity of the retaining channel 6 at a rounded portion. The tangent thereto is, however, in the preferred aspect preferred, oriented substantially horizontally, generally at an angle to the third contact location 8*c* so that the panel elements are positioned in the vertical direction relative to each other, thus preventing their release and any difference in level even when the sub-floor is uneven.

Figure 4:
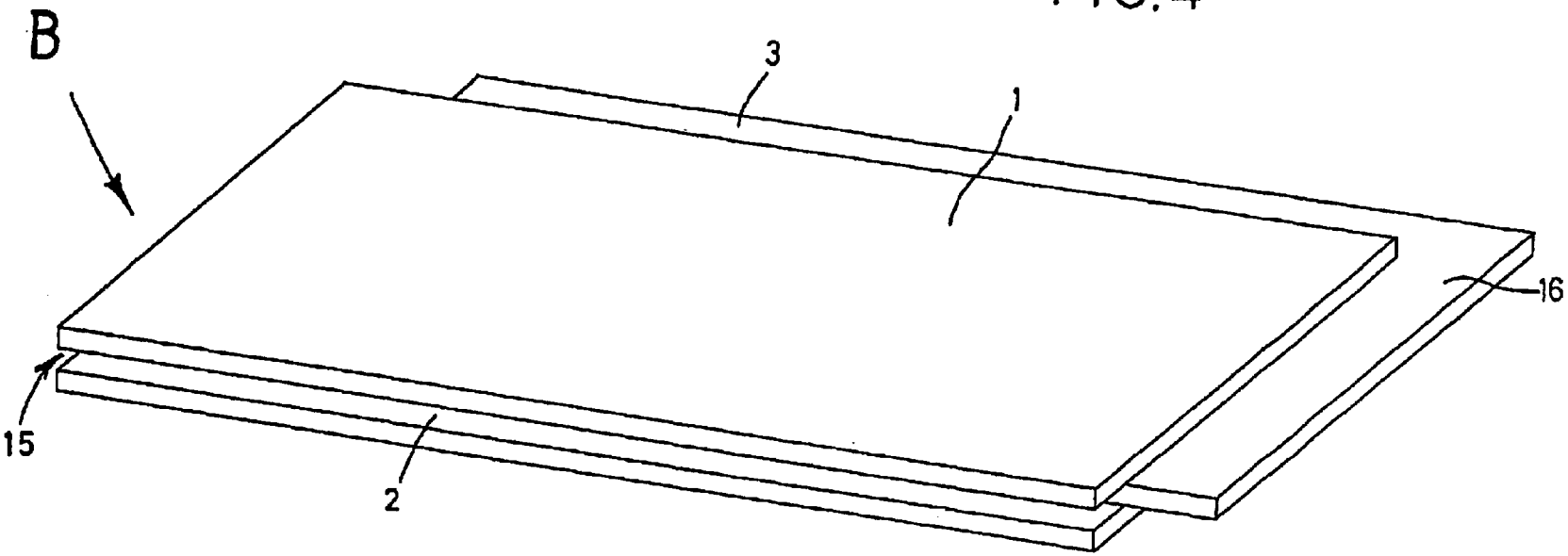
FIG. 4 show the upper face of a panel element in accordance with one embodiment of the invention.

FIG. 4 shown, in a purely diagrammatic and perspective view, a panel element 1 including a longitudinal groove 2 and tongue 3 each respectively. The panel element 1 is oriented ready for laying, i.e. with its fair or decorative face facing upwards. At its ends too, this panel element 1 is provided with an end groove 15 and an end tongue 16. In this arrangement, the longitudinal groove 2 adjoins the right-hand end of the end groove 15 as viewed in the direction "B" from above and outside of the panel element 1. In maintaining the usual laying direction of the floor covering this thus permits a systematic approach in laying in which, when the work is done with a hammer block, the block is not applied to the side edge of the panel element 1 at which the groove 2 is provided. Instead, the block can now be directly applied to the tongue 3 so that even when the block is not seated squarely any damage to the face surface of the panel element 1 is safely avoided.

The corresponding undercuts of the side groove 2 and tongue 3, respectively, particularly the configuration of the rib 5 and retaining channel 6, may, in some circumstances, be selected to be so pronounced that there is a problem in horizontally mating in the laying plane. Now, however, such pronounced under cuts are not provided in the end tongue and groove geometry so that, by shifting two adjoining panel elements 1 longitudinally relative to each other, the end of the shifted panel element 1 can be joined to a further, third panel element 1 as evident from FIGS. 5 and 6.

In FIG. 5 an end tongue 16*a* of a panel element 1 is shown cross-sectionally in greater detail. Here too, a recess 9 is provided as a glue receiving channel above the tongue 16*a*, and below the tongue 16*a* a rib 17*a* is provided which, like the side rib 5, is rounded at its underside. FIG. 6 shows the corresponding end groove 15*a* including a retaining channel 18 for receiving the rib 17*a*. The contour of the rib 17 and retaining channel 18 enable the tongue 16*a* to be inserted in its corresponding groove 15*a*, simply by shifting the panel 1 featuring the tongue 16*a* horizontal against the adjoining panel 1 featuring the groove 15*a*. In the scope of the end interlock too, the tongue is configured oversize so that the rib 17*a* provided on the tongue is accommodated in the retaining channel 18 like a press fit as is also the case in the side interlock.

FIGS. 7 and 8 show an alternative aspect of the end groove 15*b* and the end tongue 16*b*. The tongue 16*b* does not extend in the horizontal plane of the panel element 1 but more or less perpendicular thereto downwards. The corresponding groove 15*b* opens upwards to receive the tongue 16*b*.

For such a configuration of the end groove 15*b* and tongue 16*b* a method of laying is selected in which the panel element 1 to be laid is located at an angle to the already laid panel element and is then swiveled downwards in the way as already described. Then, however, this panel element is no longer shifted horizontally. Instead, the panel element is arranged right from the start to overlap by its end the end of an already laid panel element 1 so that swiveling down the panel element to be laid causes its end with the tongue 16*b* to engage the groove 15*b* of the end of the already laid panel element 1. Although this movement of the lowered panel element 1 is a swiveling movement in actual fact, the mating of groove 15*b* and tongue 16*b* can be substantially described as a lowering movement occurring transversely to the face surface area of the panel element 1.

In this arrangement, the groove 15*b* comprises an undercut and the tongue 16*b* is contoured with corresponding protuberances. In the example shown in FIGS. 7 and 8 tongue 16*b* has a slightly bulging contour so that, on overcoming a latching force with which the tongue 16*b* is urged into the groove 15*b*, retaining forces can be built up which safeguard a laid panel element 1 from lifting out of place at its edge portion, as well, making it possible to configure a smooth floor face surface free of trip edges, even in the region of parting locations at the ends of two adjoining panel elements.

Contouring the tongue 16*b* and groove 15*b* as shown in FIGS. 7 and 8 now permits, in overcoming the corresponding latching forces, non-destructive release and disassembly of the panel elements 1. It is particularly when the tongue 16*b* widens at its underside relatively gradually and narrows further upwards more pronouncedly that this permits comparatively easy insertion of the tongue 16*b* into the groove 15*b*, but results in considerably higher retaining forces which make it more difficult to disassemble the two panel elements 1. In this case it may be provided for to part the ends from each other not by overcoming the latching forces but by a shifting movement in which groove 15*b* and tongue 16*b* are shifted mutually in their longitudinal direction.

The groove 15*b* advantageously comprises a larger free cross-section than the cross-section of the tongue 16*b* so that the tongue 16*b* can be retained "dead" or by a prestress acting downwards within the groove 15*b*, thus assuring even for certain dimension tolerances of the tongue 16*b* that no pressure locations materialize between the tongue 16*b* and groove 15*b* that urge the tongue 16*b* upwards and which could produce a trip edge in the region of the parting location between the two ends of adjoining panel elements. Instead, advantageously provided for contact is made exclusively in each upper region between the groove 15*b* and tongue 16*b* so that the tongue 16*b* is reliably retained in the groove 15*b* due to the undercut therein.

Having now described a few embodiments of the invention, it should be apparent to those skilled in the art that the foregoing is merely illustrative an not limiting, having been presented by way of example only. Numerous modifications and other embodiments are with the scope of one of ordinary skill in the art and are contemplated as falling with the scope of the invention.

What is claimed is:

1. A panel element interconnectable with other same type panel elements on a laying plane to form a floor, said panel element comprising:

a groove along a side of said panel element formed by an upper groove cheek and a lower groove cheek, said lower groove cheek having a retaining channel oriented parallel to said side;

a tongue along another side of said panel element and having, at an underside, a rib oriented parallel to said another side, said tongue adapted for insertion into a groove of an adjoining, same type panel element and said rib adapted for insertion into a retaining channel of the groove of the adjoining, same type panel element;

wherein said tongue cooperates with the groove of the adjoining panel element to prevent separation of said panel element and the adjoining panel element in an upwards direction and said rib cooperates with the channel of the adjoining panel element to prevent separation of said panel element and the adjoining panel element in a sideways direction perpendicular to said another side;

wherein said upper groove cheek is ramped upwards to a mouth of said groove so as to create an insertion channel for a tongue of a second same type panel element;

the groove of the adjoining panel element and said tongue of said panel element, defining four contact locations when interconnected, including:

a first contact location between an upper side of said tongue of said panel element, and an upper groove cheek of the groove of the adjoining same type panel element;

a second contact location between said underside of said tongue of said panel element at a position outboard of said rib, and the lower groove cheek of the groove of the adjoining same type panel element;

a third contact location between an inboard portion of said rib of said panel element, and an outer sidewall of a retaining channel of the adjoining same type panel element; and a fourth contact location at said underside of said tongue of said panel element at a position inboard of said rib;

wherein said third contact location is on a first plane and said fourth contact location is on a second plane, said first plane and said second plane being non-parallel.

2. The panel element of claim 1, wherein a material thickness of said panel element above said tongue or said groove is at least as thick as another material thickness of said panel element below said tongue or said groove, respectively.

3. The panel element of claim 1, further comprising an upper contact surface area extending up to an upper-portion of said another side of said panel element above said tongue, and a recess configured to receive extraneous substances above said tongue and below said upper contact surface area.

4. The panel elements of claim 3, wherein contact between said upper contact surface area of said panel element and the adjoining panel element prevents movement of said panel element in a sideways direction toward the adjoining panel element, and contact at said third contact location prevents movement of said panel element in a sideways direction away from the adjoining panel element, contact at said upper contact surface area and at said third contact location providing snug contact of said panel element and the adjoining panel element in said sideways direction perpendicular to said another side.

5. The panel elements of claim 1, wherein said underside of said tongue ramps upwards to a free end of said tongue.

6. The panel elements of claim 1, wherein a transition from said retaining channel to an outboard portion of said lower groove cheek is rounded.

7. The panel element of claim 1, wherein two second sides of said panel element each have one of an end groove and an end tongue.

8. The panel element of claim 7, wherein said end grooves of said panel element and a tongue of an already laid same type panel element are adapted to be interconnected by a shifting movement of said panel element in the laying plane.

9. The panel element as set forth in claim 7, wherein an end groove of an already same type laid panel element and said end tongue of said panel element are adapted to be interconnected by a lowering movement of said panel element substantially transversely to the laying plane.

10. The panel element of claim 7, wherein said groove on said side of said panel element adjoins a right hand end of said end groove on said panel element.

* * * * *